US005556179A

United States Patent [19]

Weidner

[11] Patent Number: 5,556,179

[45] Date of Patent: Sep. 17, 1996

[54] RETRACTABLE SUSPENSION SHELF

[76] Inventor: Merwyn C. Weidner, P.O. Box 98574, Des Moines, Wash. 98198

[21] Appl. No.: 370,155

[22] Filed: Jan. 9, 1995

Related U.S. Application Data

[63] Continuation-in-part of Ser. No. 55,569, May 3, 1993, Pat. No. 5,385,399, and a continuation-in-part of Ser. No. 368, 433, Dec. 30, 1994.

[51] Int. Cl.[6] ..... A47F 7/00

[52] U.S. Cl. ..... 312/190; 312/323; 312/319.1

[58] Field of Search ..... 312/190, 192, 312/322, 323, 319.1, 330.1, 334.1, 319.2

[56] References Cited

U.S. PATENT DOCUMENTS 428,406 5/1890 Noll et al. .
634,713 10/1899 West ..... 312/191
832,426 10/1906 Sell .
1,205,604 11/1916 Dungan .
1,274,446 8/1918 Ratigan .
1,517,935 12/1924 Azamber ..... 312/319.2 X
4,195,577 4/1980 Gross .
5,215,364 6/1993 Moore .
5,385,399 1/1995 Weidner ..... 312/190

*Primary Examiner*—Hoang Nguyen
*Attorney, Agent, or Firm*—Graybeal Jackson Haley & Johnson

[57] ABSTRACT

A retractable suspension shelf adapted to be mounted under a supporting surface such as the undersurface of a kitchen cabinet or the like. At least one of the leg assemblies at the corners of the shelf panel includes tensioned spring exerting movement restraining force on a lateral bend of the leg pivotally interconnecting the shelf panel with a base sheet or other supporting surface. The tensioned spring positively retain the leg or legs in either a substantially perpendicular position relative to the base sheet or the supporting structure, or in a substantially parallel position with respect to such base sheet or supporting structure for nonuse or storage of the shelf, as desired.

12 Claims, 2 Drawing Sheets

RETRACTABLE SUSPENSION SHELF

CROSS REFERENCE TO RELATED APPLICATIONS

This application is a continuation-in-part of my U.S. patent application Ser. No. 08/055,569, filed May 3, 1993, entitled Document Storage and Display Cabinet, and which issued Jan. 1, 1995, as U.S. Pat. No. 5,385,399. It is also a continuation-in-part of my copending U.S. patent application Ser. No. 08/368,433, filed Dec. 30, 1994, entitled Document Display Stand now allowed.

BACKGROUND OF THE INVENTION

1. Field of the Invention

This invention relates to retractable suspension shelves and leg assemblies for such shelving, and more particularly to such shelving with leg assemblies involving pedestals attachable directly or indirectly to support structure and comprising tension spring means exerting frictional force on suspension legs pivotally movable on such pedestal means with such frictional force being exerted throughout a full 180° pivotal movement of the leg means to positively retain the leg means in either a substantially perpendicular position with respect to the support surface on which the pedestal is mounted or to positively retain the leg means in a substantially parallel position with respect to such support surface.

2. Description of the Prior Art

Suspension or hanging shelves are known as in Gross U.S. Pat. No. 4,195,577, and Moore U.S. Pat. No. 5,215,364. In the case of the Gross hanging shelf, it is designed to hang from an adjustable support rod within a window frame and, although removable, has no retractability. In the case of the Moore shelf, it houses a withdrawable file drawer but is otherwise simply a stationary installation of fixed form.

Also known are trays or drawers with holddown means such as disclosed in the prior art patents referred to in my copending application entitled Document Display Stand, namely Noll et al U.S. Pat. No. 428,406, Sell U.S. Pat. No. 832,426, Dungan U.S. Pat. No. 1,205,604, and Ratigan U.S. Pat. No. 1,274,446. None of these, however, discloses or suggests any structure having any similarity to a retractable suspension shelf.

SUMMARY OF THE INVENTION

The present invention provides a suspension shelf which is self-contained and, once installed, is readily retractable for storage or extendable in a suspended attitude for use, simply by movement of its legs against the frictional force of tensioned spring means. Consistent with a contemporary trend toward under cabinet mounting of kitchen accessories and the like, the suspension shelf of the present invention provides readily available and readily accessible shelving in a manner compatible with such accessory usage and in a manner readily storable for nonuse, in which position it is quite thin in lateral dimension and unobtrusive.

These and other objects, features and advantages of the suspension shelving and the tensioned spring leg assemblies incorporated therein will occur to those skilled in the art to which the invention is addressed, giving due consideration to the preferred embodiment thereof discussed below in conjunction with the accompanying drawings.

DESCRIPTION OF THE PREFERRED EMBODIMENT

Figure 1:
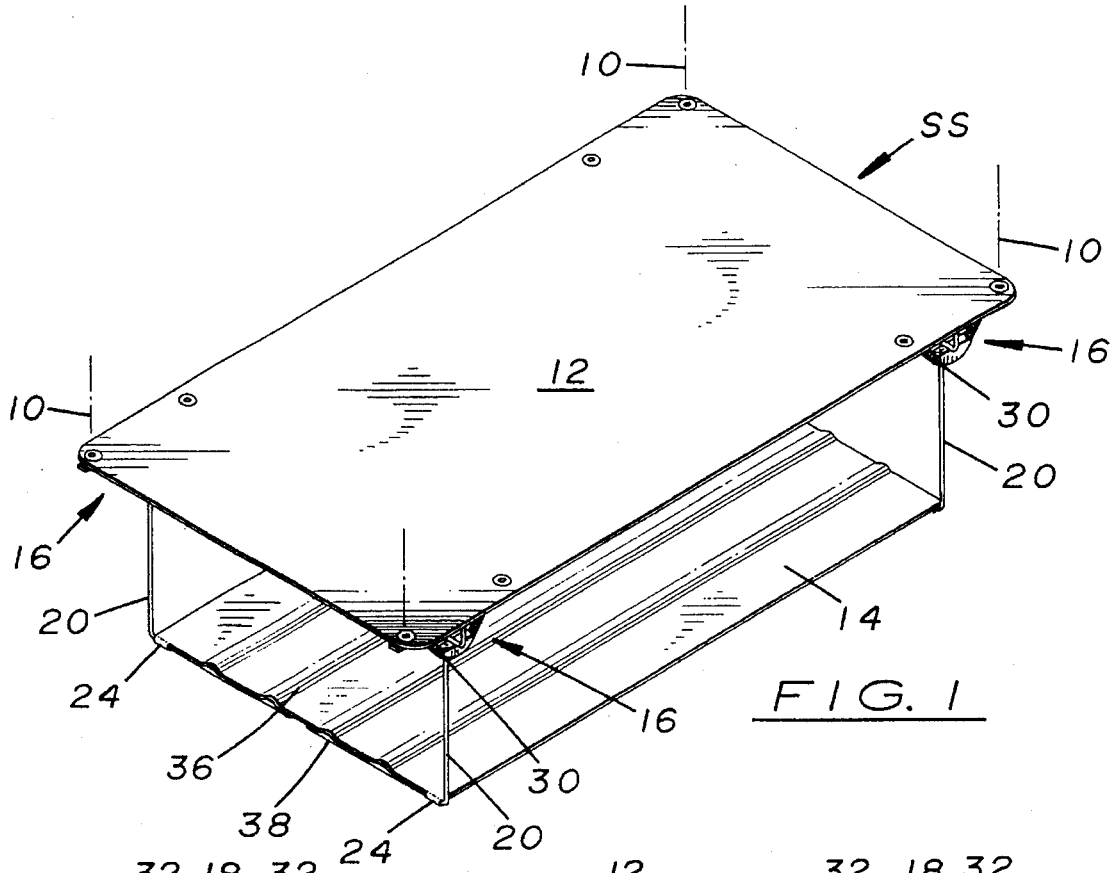
FIG. 1 is an isometric view from an upper aspect of a suspension shelf according to the present invention, with the leg assemblies thereof and shelf panel in the position of use of the shelf.
Figure 2:
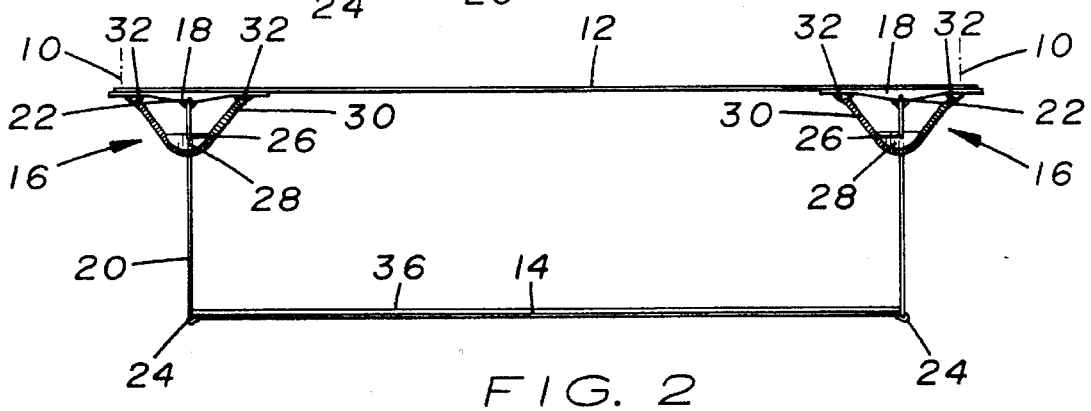
FIG. 2 is a side elevational view of the shelf shown in FIG. 1.

The accompanying drawings illustrate a suspension shelf SS, otherwise termable a hanging shelf or underslung shelf which is adapted to be mounted under the undersurface (not shown) of a kitchen cabinet or the like by suitable fasteners such as screws or other fastening means schematically indicated at 10. Specifically, as illustrated, the shelf SS includes a base sheet 12, a shelf panel 14, and four leg assemblies, generally indicated at 16 and each including a pedestal 18 attached to the base sheet 12 and a wire leg 20 which is pivotally connected at trunnion 22 to the pedestal 18 and at trunnion 24 to the shelf panel 14. The leg 18 in each instance comprises a lateral bend, also termable a knee bend 26 on which a slide or glide sector 28, preferably of a relatively low friction material such as nylon, is pivotally retained. Spanning the lateral or knee bend 26 and slider or glide sector 28 in each instance is a tensioned spring 30 attached at its ends to eyes 32 adjacent the ends of the pedestal 18.

Figure 4:
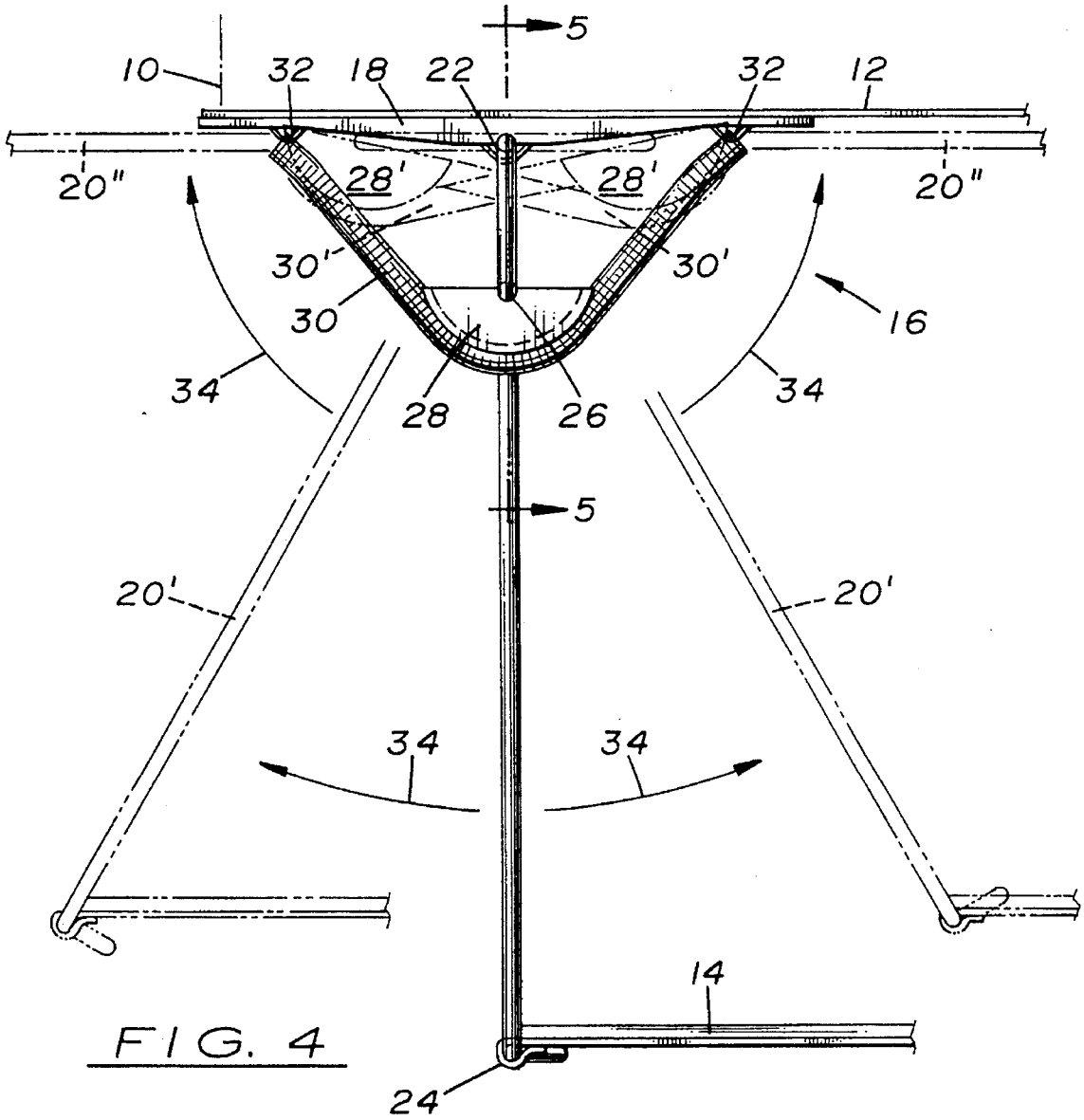
FIG. 4 is a detail view on an enlarged scale of one of the leg assemblies and associated base and shelf panel components of the shelf shown in FIGS. 1–3, including a showing thereof in the position of use of the shelf panel in solid line and showings thereof in broken line in other positions including the retracted positions thereof.
Figure 5:
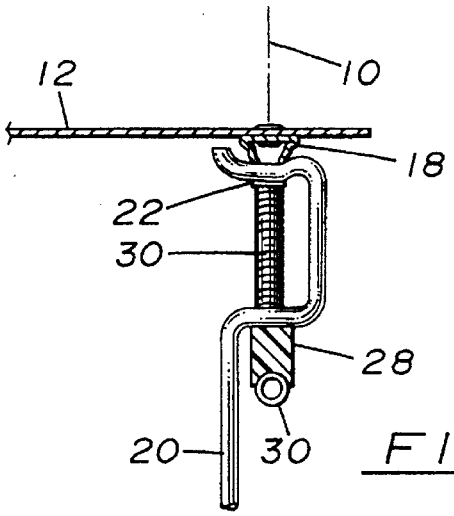
FIG. 5 is a cross-sectional view of the pedestal and near pedestal components of the leg assembly shown in FIG. 4, taken substantially along line 5—5 thereof.

As best shown in connection with FIGS. 4 and 5, the tension on the spring 30 is such as to exert substantial friction and consequently a substantial force on the lateral bend 26 of leg 20 through the slide 28. This force is sufficient to stabilize and retain the leg 20 in a substantially perpendicular position relative to the shelf 14 and base sheet 12 when in the position shown in solid line in FIG. 4 because the longitudinal pull exerted by the spring 30 is substantially equal on both sides, i.e. by the equal length spans of the spring 30 portions between the slide 28 and the anchored ends of the spring 30 at eyes 32. However, if the leg 20 is moved by a user in a pivotal manner toward an acute angular position, as indicated by the arrows 34, the opposing forces exerted by the spring 30 become unequal and at acute angle positions of the leg 20, approximately as shown by broken lines as indicated at 20' in FIG. 5, the spring 30 acts to positively force and retain the leg 20 and the shelf panel 14 in a collapsed or retracted position at one side or the other of the pedestal 18, such positions being with the shelf panel 14 substantially parallel to and closely adjacent the base sheet 12, as shown in FIG. 4 by broken lines at 20". As will be apparent, for this to happen the length of spring 30 is selected so that it continues to be under tension even though shortened when the leg 20 is in one of the collapsed positions 20". FIG. 4 also includes a showing in broken lines at 30' of the positions of the spring 30 when the leg is in one of such retracted positions.

Figure 3:
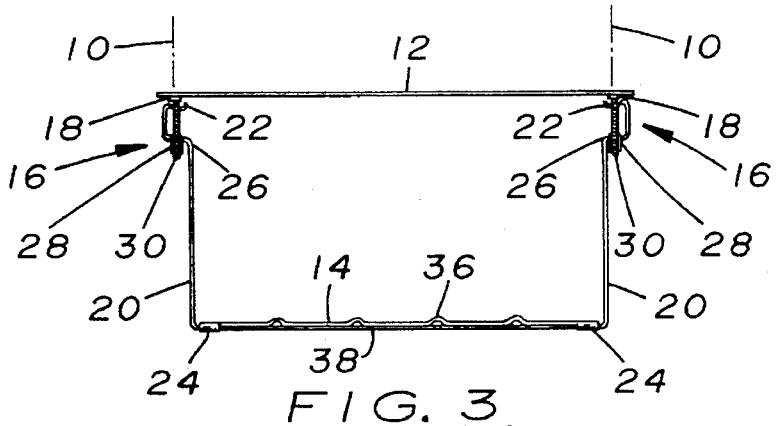
FIG. 3 is an end elevational view thereof.

Providing a degree of structural strength and support for the shelf 14 are longitudinally extending ribs, certain of which are indicated at 36 and end spanning wire segments 38 (FIGS. 1 and 3) which interconnect the ends of the legs 20 and which are suitably formed integrally with the adjacent legs 20 as shown, for simplicity of construction.

While the illustrated suspension shelf includes four leg assemblies each with tensioned spring retention of the suspended position of the shelf, with legs substantially perpendicular to the supporting surface the suspension stability and positive retractability of the shelf does not necessarily require that all legs be restrained in extended position by spring friction. In certain simplified arrangements only some or even only one such leg can suffice for the purpose with the other legs being passive in the sense of being simple wire or like spans, without spring loading and either with or without a lateral bend.

As a matter of convenience in handling and for simplicity in some installations the disclosed and illustrated shelf includes a base sheet to which the pedestals of the leg assemblies are attached. However, it is possible in some instances to attach the pedestal means directly to the supporting structure undersurface, if desired.

Also evident is the possibility of redesign of the shelf to place the leg assemblies at locations other than at the corners of the shelf.

While the shelf as disclosed and illustrated is indicated as adaptable for and usable in connection with its attachment under a support surface such as the undersurface of a kitchen cabinet or the like, which would place the shelf in an essentially horizontal attitude, there can of course be applications in some instances where the supporting surface to which the shelf is attached is in an other than horizontal attitude.

While the foregoing disclosure contemplates that the leg assemblies have essentially two positions, i.e. a substantially vertical position with respect to the shelf panel when the shelf panel is in a suspended position for use, and a substantially parallel position with respect to the shelf panel and base sheet and/or supporting structure for nonuse or storage of the shelf, it is possible, by reason of the continued tension of the tensioned spring of the leg assemblies on the legs, for the space between the base sheet and/or supporting structure on the one hand and the pivotally movable shelf panel on the other hand to be used for storage of documents, books, and the like, with the tension spring means performing a holddown of gripping function providing positive pressure on whatever documents or articles are in the space between the base sheet or supporting structure on the one hand and the shelf panel on the other hand. This can occur with the legs at various small acute angles with respect to the base sheet and/or supporting structure, e.g. 30° or less, for example.

These and other advantages, features, modifications and adaptations of the structure and structural arrangements of the present invention will be apparent to those skilled in the art to which the invention is addressed, within the scope of the following claims.

What is claimed is:

1. A retractable suspension shelf adapted to be mounted under a supporting surface and be readily movable from a position of use with the shelf situated below and generally equispaced from said supporting surface to a position of nonuse or storage with all its parts situated adjacent to said supporting surface, said shelf comprising:

a shelf panel, and leg assemblies each comprising a pedestal mounted in fixed relationship to said supporting surface, and a leg pivotally interconnecting said pedestal and said shelf panel, at least one of said leg assemblies comprising a lateral bend intermediate the span thereof between said pedestal and said shelf, and tensioned spring means spanning said pedestal and said lateral bend and exerting force on said lateral bend to frictionally restrain movement of said leg when said leg is in a substantially perpendicular position with respect to said supporting surface and to maintain said leg close to said supporting surface when said leg is in an other than a substantially perpendicular position with respect to said supporting surface.

2. A retractable suspension shelf according to claim 1, wherein said shelf comprises four of said leg assemblies and four of said tensioned spring means.

3. A retractable suspension shelf according to claim 1, wherein a glide sector element is pivotally mounted on said lateral bend of said leg and is engaged by said spring tensioned means to in turn exert force on said lateral bend.

4. A retractable suspension shelf according to claim 3, wherein said leg is wire and said slide sector is nylon.

5. A retractable suspension shelf according to claim 3, wherein said shelf comprises four of said leg assemblies and four of said tensioned spring means, with each of said leg assemblies pivotally connected at a respective corner of said shelf panel.

6. A retractable suspension shelf according to claim 5, wherein said shelf panel is rectangular and said leg assemblies are interconnected at the ends thereof and across the ends of said shelf panel to augment the structural strength of said shelf panel.

7. A retractable shelf adapted to be mounted under the undersurface of a cabinet and be readily movable from a position of use with the shelf situated below and generally equispaced from said undersurface to a position of nonuse or storage with all its parts situated snugly close to said undersurface, said retractable shelf comprising:

a base sheet for placement next to and attachment to said undersurface, a shelf panel, leg assemblies interconnecting said base sheet and said shelf panel, each of said leg assemblies comprising a pedestal attached to said base sheet, with a wire leg extending between said base sheet and said shelf panel, said wire leg having a lateral bend intermediate the length thereof between said base sheet and said shelf panel, means pivotally connecting each said leg with said pedestal, means pivotally connecting each said leg with said shelf panel and, tensioned spring means spanning said pedestal and said leg lateral bend and exerting force on said lateral bend to positively retain said leg in either a substantially perpendicular position with respect to said base sheet and said shelf panel or a substantially parallel position with respect to said base sheet and said panel for respective use or storage of said shelf as desired.

8. A retractable suspension shelf according to claim 7, wherein said shelf comprises four of said leg assemblies and four of said tensioned spring means for restraining leg movement.

9. A retractable suspension shelf according to claim 7, wherein a glide sector element is pivotally mounted on said lateral bend of said leg and is engaged by said tensioned spring means to in turn exert force on said lateral bend.

10. A retractable suspension shelf according to claim 9, wherein said leg is wire and said slide sector is nylon.

11. A retractable suspension shelf according to claim 10, wherein each of said four leg assemblies is pivotally connected at a respective corner of said shelf panel.

12. A retractable suspension shelf according to claim 11, wherein said shelf panel is rectangular and said leg assemblies are interconnected at the ends thereof and across the ends of said shelf panel to augment the structural strength of said shelf panel.

* * * * *